US012722930B2

(12) United States Patent
Sirbu Villa

(10) Patent No.: US 12,722,930 B2
(45) Date of Patent: Sep. 1, 2026

(54) STRIP FEEDING APPARATUS, IN PARTICULAR FOR A STIRRER DISPENSER IN A BEVERAGE VENDING MACHINE

(71) Applicant: EVOCA S.P.A., Valbrembo (IT)

(72) Inventor: Dan Alexie Sirbu Villa, Valbrembo (IT)

(73) Assignee: EVOCA S.P.A., Valbrembo (IT)

( * ) Notice: Subject to any disclaimer, the term of this patent is extended or adjusted under 35 U.S.C. 154(b) by 100 days.

(21) Appl. No.: 18/293,158

(22) PCT Filed: Aug. 3, 2022

(86) PCT No.: PCT/IB2022/057193

§ 371 (c)(1),
(2) Date: Jan. 29, 2024

(87) PCT Pub. No.: WO2023/012684

PCT Pub. Date: Feb. 9, 2023

(65) Prior Publication Data

US 2024/0359942 A1 Oct. 31, 2024

(30) Foreign Application Priority Data

Aug. 4, 2021 (IT) ..... 102021000021173

(51) Int. Cl.
*B65H 35/06* (2006.01)

(52) U.S. Cl.
CPC ..... *B65H 35/06* (2013.01)

(58) Field of Classification Search
CPC ..... G07F 11/00; G07F 11/004; B65H 19/00; B65H 19/12; B65H 19/123; B65H 2601/322
USPC ..... 242/310, 316, 370
See application file for complete search history.

(56) References Cited

U.S. PATENT DOCUMENTS 5,289,985 A * 3/1994 Cocchi ..... B65H 19/123 242/559

FOREIGN PATENT DOCUMENTS

| | | | |
|---|---|---|---|
| IT | 201900013083 | A1 | 1/2021 |
| JP | 3209043 | B2 | 9/2001 |
| JP | 2012214260 | A | 11/2012 |
| JP | 2014016915 | A | 1/2014 |
| JP | 5978721 | B2 | 8/2016 |
| WO | 2020225669 | A1 | 11/2020 |

OTHER PUBLICATIONS

Espacenet machine translation of JP2012214260A; https://translationportal.epo.org/emtp/translate/?ACTION=description-retrieval&COUNTRY=JP&ENGINE=google&FORMAT=docdb&KIND=A&LOCALE=en_EP&NUMBER=2012214260&OPS=ops.epo.org/3.2&SRCLANG=ja&TRGLANG=en (Year: 2012).*

(Continued)

*Primary Examiner* — Leslie A Nicholson, III
(74) *Attorney, Agent, or Firm* — Ballard Spahr LLP

(57) ABSTRACT

In a strip feeding apparatus, particularly for a stirrer dispenser in a beverage vending machine, a reel coupled to a support to rotate about an unwinding axis is moved from a retracted strip feeding position to an extracted reel loading or changing position via a handling device configured to arrange the unwinding axis horizontally when the reel is arranged in the retracted strip feeding position and tilting downwards and towards a flat reel abutment wall when the support is arranged in the reel loading or changing position.

5 Claims, 8 Drawing Sheets

(56) References Cited

OTHER PUBLICATIONS

Espacenet machine translation of JP2014016915A; https://translationportal.epo.org/emtp/translate/?ACTION=description-retrieval&COUNTRY=JP&ENGINE=google&FORMAT=docdb&KIND=A&LOCALE=en_EP&NUMBER=2014016915&OPS=ops.epo.org/3.2&SRCLANG=ja&TRGLANG=en (Year: 2014).*
International Preliminary Report on Patentability for International Application No. PCT/IB2022/057193 mailed Aug. 10, 2023.
International Search Report and Written Opinion from International Application No. PCT/IB2022/057193 mailed Nov. 18, 2022.
Reply to Written Opinion for International Application No. PCT/IB2022/057193 filed Jun. 1, 2023.

* cited by examiner

STRIP FEEDING APPARATUS, IN PARTICULAR FOR A STIRRER DISPENSER IN A BEVERAGE VENDING MACHINE

CROSS-REFERENCE TO RELATED APPLICATIONS

This patent application is a U.S. national stage of PCT International Application No. PCT/IB2022/057193 filed on Aug. 3, 2022, which claims priority to Italian Patent Application No. 102021000021173 filed on Aug. 4, 2021, the entire disclosure of each of which is incorporated herein by reference.

TECHNICAL FIELD OF THE INVENTION

This invention relates to a strip feeding apparatus, in particular for a stirrer dispenser in a beverage vending machine, to which the following discussion will explicitly refer without any loss of generality thereby.

PRIOR ART

In the vending sector, it is known to arrange inside beverage vending machines a stirrer dispenser that is controlled by an electronic control unit of the beverage vending machine to dispense a stirrer directly inside a beverage cup.

A stirrer is normally released into a cup before this is filled with a beverage and its dispensing can be subject to a user's request for sugar in the selected beverage.

Different types of stirrers are today used in beverage vending machines. Fair use is still made of plastic stirrers that, however, are gradually losing popularity due to the known problems connected to environmental pollution.

Biodegradable stirrers made of paper material are increasingly replacing plastic stirrers. One example of a paper stirrer is described in WO 2020/225669 A1 in the name of the present Applicant.

WO 2020/225669 A1 discloses paper stirrers made from a paper strip reel arranged in a stationary unwinding station and housed in a casing, in which it is slidably cantilevered on an unwinding hub idly rotating about a fixed horizontal axis. The reel is kept, in use, engaged with the hub by a closing lid of the casing. The unwound strip is advanced through an underlying dragging and shaping apparatus and then through a cutting apparatus where it is cut to size to form stirrers with a predefined length depending on a height of the beverage cup in which the beverage is dispensed.

Although shaping stirrers from paper strip reels allows stable stirrers to be produced, in a short time and of any length by simply controlling the strip advancement, this production method suffers from the drawback of generating relatively long machine stoppages any time it is necessary to replace the reel.

The above essentially derives from the fact that at every reel replacement, once a closing lid and a core of the finished reel, if any, are removed, a new reel is first slidably inserted on the unwinding hub.

Before mounting the lid back, the new reel is partially unwound and, at the same time, an initial portion of the strip is inserted manually in the underlying dragging and shaping apparatus. The casing is then closed with the lid, which holds the reel in place during its entire unwinding.

The initial, manual unwinding of the strip causes, very often, an axial sliding of the reel on the hub may result in the reel uncoupling from the hub and falling to the ground. The uncoupling of the reel from the hub occurs freely and quickly and, often, without the operator having the time to effectively intervene because his hands are engaged in inserting the strip in the underlying dragging and shaping apparatus.

Inevitably, the reel falls to the ground, deforming, in some cases, and unwinding, in others, so it is no longer usable, at least for hygiene issues, and must, therefore, be replaced with a new reel.

Despite being apparently simple from a notional point of view, in practice the reel replacement operation entails high operation cost and time, as well as high sheet material waste, in addition to generating losses in terms of beverages that may not be dispensed.

In some cases, the intervention times are then additionally increased by the lid removal requiring the disassembly of one or more components of the beverage vending machine that, once the reel is replaced, need to be reassembled.

A strip reel unwinding apparatus is for example described in JP 201401695 A.

SUBJECT AND SUMMARY OF THE INVENTION

An aim of the present invention is to provide a strip feeding apparatus, in particular for forming stirrers for use in a beverage vending machine, which allows the above-described issues to be simply and economically overcome.

A particular purpose of the present invention is to provide a strip feeding apparatus which allows a strip reel to be easily replaced in very little time and strip waste to be avoided.

According to the present invention, a strip feeding apparatus, in particular for a stirrer dispenser in a beverage vending machine, is provided.

The present invention also relates to a stirrer dispenser in a beverage vending machine.

According to the present invention, a stirrer dispenser in a beverage vending machine is also provided.

The present invention also relates to a method for feeding a strip reel to an apparatus for forming and cross-cutting the strip.

According to the present invention, a method for feeding a strip reel to an apparatus for forming and cross-cutting the strip is provided.

BRIEF DESCRIPTION OF THE DRAWINGS

This invention will now be described with reference to the attached drawings that illustrate a non-limiting embodiment thereof, in which.

DETAILED DESCRIPTION OF PREFERRED EMBODIMENTS OF THE INVENTION

The invention will now be described in detail with reference to the figures attached to enable a person skilled in the art to produce it and use it. Various modifications to the embodiments described will be immediately clear to persons skilled in the art and the generic principles described may be applied to other embodiments and applications without, for this reason, departing from the protective scope of this invention, as defined in the attached claims. Therefore, this invention must not be considered as limited to the embodiments described and illustrated but they must be granted the widest protective scope compliant with the principles and features described and claimed herein.

Figure 1:
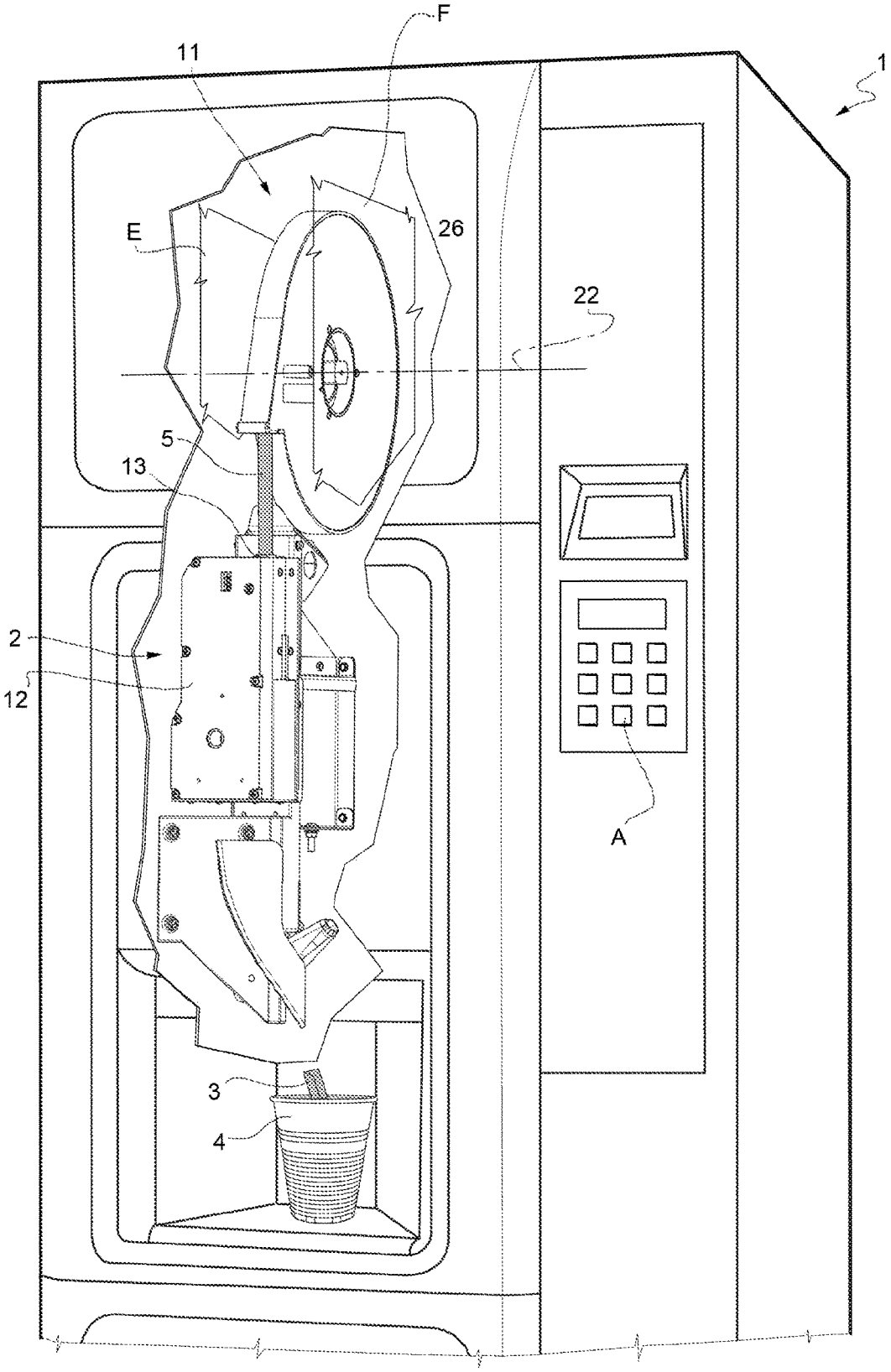
FIG. 1 is a front perspective view of a beverage vending machine provided with a strip feeding apparatus for forming stirrers according to a preferred embodiment of the present invention.

In FIG. 1, reference numeral 1 indicates, as a whole, a beverage vending machine provided with a beverage selection keypad A dispensed, a stirrer dispenser 2 to dispense stirrers 3 in beverage cups 4.

Figure 6:
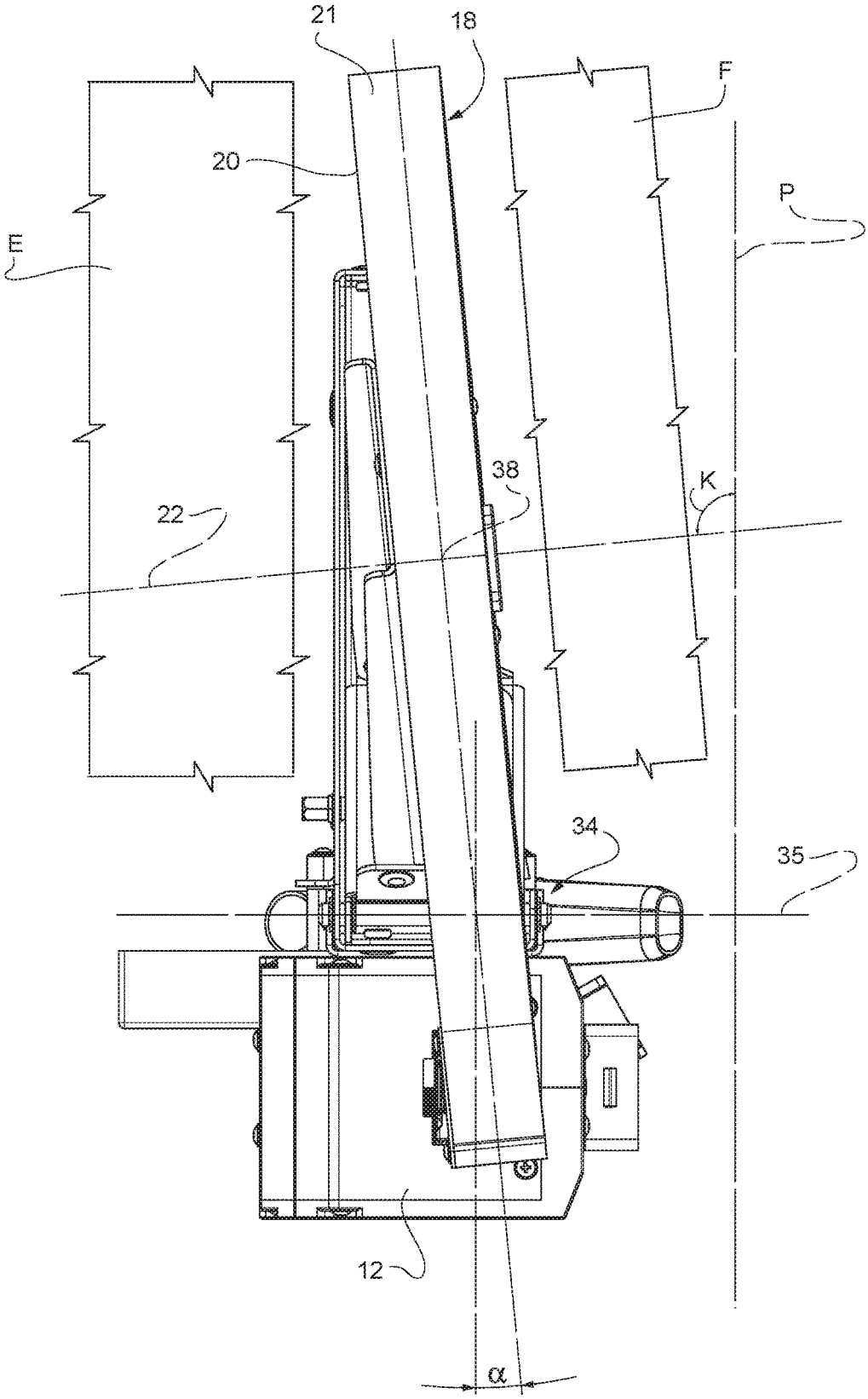
FIG. 6 is a top view of the assemblies shown in FIGS. 2 and 4.

In the example shown, the stirrer dispenser 2 is arranged inside the beverage vending machine 1 between a sugar dispensing apparatus E and a cup supply apparatus F, both of which are known per se and, hence, are only schematically shown. The sugar dispensing apparatus E and the cup supply apparatus F are arranged on opposite sides of the stirrer dispenser 2, near the same (FIGS. 1 and 6).

The beverage vending machine 1 is electronically controlled by an electronic control unit to automatically dispense, during a beverage preparation cycle, a stirrer 3 directly inside a cup 4.

In a first variant, the stirrer dispenser 2 is arranged inside the beverage vending machine 1 so as to dispense a stirrer 3 inside of a dedicated cup withdrawal compartment accessible to the user from the outside, in response to a beverage selection by a user on the beverage selection keypad.

In a different configuration, the stirrer dispenser 2 is distinct from, and externally connected to, the beverage vending machine 1 so as to form a stand-alone, self-contained device operable by a user independently of the beverage vending machine 1 to dispense a stirrer 3 on demand.

Figure 8:
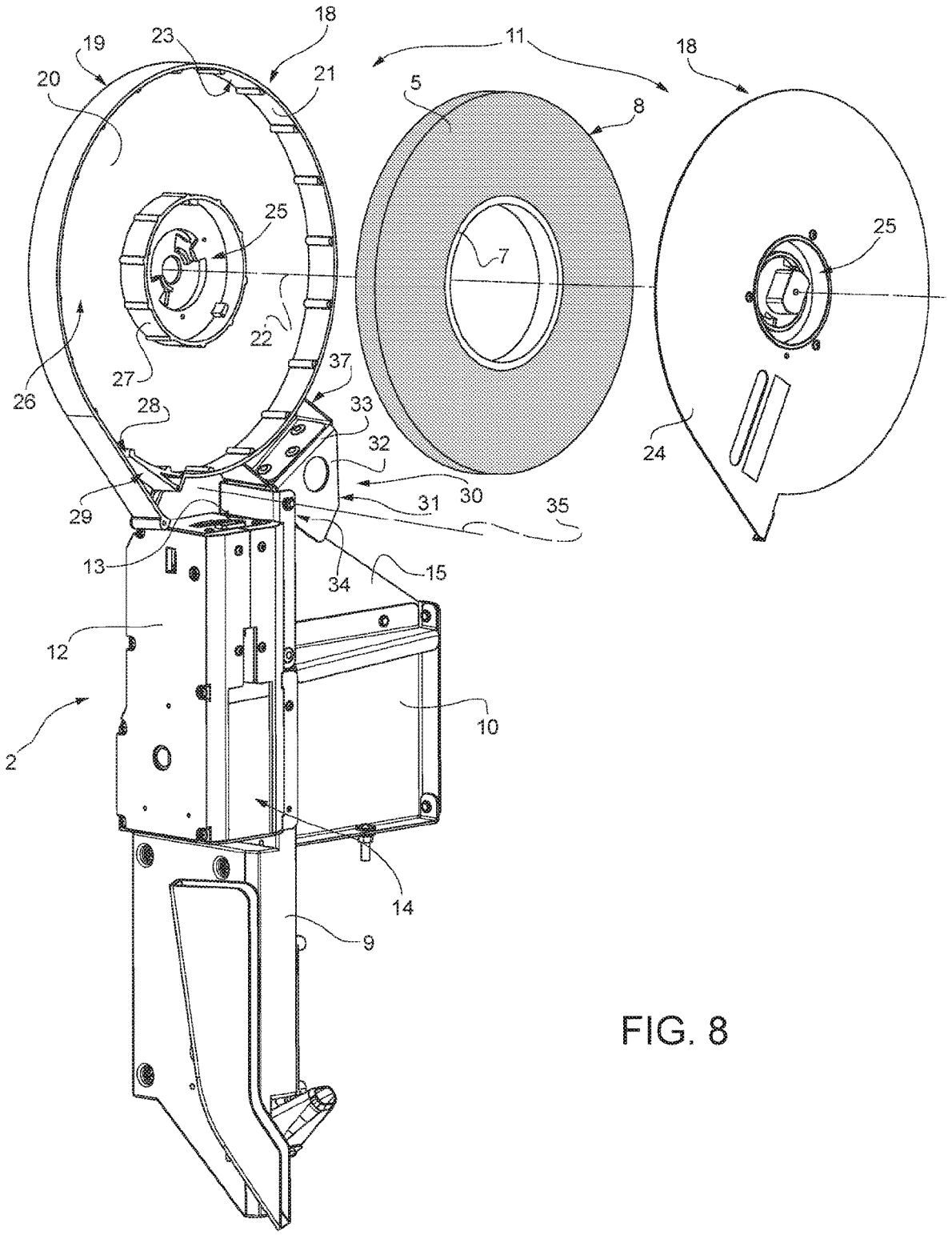
FIG. 8 is a perspective view of the assembly in FIG. 3 partially broken down into components.

In all cases, the stirrer dispenser 2 is configured to successively form and dispense stirrers 3 that, conveniently, are disposable stirrers made from a strip 5 made of sustainable material for food use, preferably biodegradable or compostable and preferably plastic-free, for example waterproof cardboard, wound around a core 7 to form a reel 8 (FIG. 8).

The stirrer dispenser 2 comprises a support frame 9 for mounting to a structure 10 of the beverage vending machine 1, a strip feeding apparatus 11 releasably coupled to either the frame 9 or the structure 10, and a shaping and cross-cutting apparatus 12 operable to form stirrers 3 from the strip 5.

The forming and cross-cutting apparatus 12, known per se and, hence, not described in detail, is arranged below the strip feeding apparatus 11 and has an upper inlet opening 13 for receiving the strip 5 unwound from the reel 8 (FIGS. 1-4 and 8) and a lower strip cross-cutting device 14.

With reference to the attached figures, the strip feeding apparatus 11 comprises an attachment frame 15 stably connected to the structure 10 and/or to the frame 9 and a casing 18 for housing the reel 8.

With specific reference to FIG. 8, the casing 18 comprises a hollow body 19 that has a flat bottom wall 20 for axial abutment for the reel 8 and a tubular, substantially cylindrical, side wall 21, which extends from the bottom wall 20 coaxially to an unwinding axis 22 of the reel 8 orthogonal to the bottom wall 20. The side wall 21 delimits an opening 23 for the insertion/removal of the reel 8 closed by a removable lid 24 connected to the bottom wall 20 via a bayonet joint 25, or another, equivalent, releasable joint. The body 19 and the lid 24 mutually delimit a chamber 26 with a size approximating an external size of the reel 8 and houses a hub 27 (FIG. 8) designed to support the reel 8 and firmly connected to the bottom wall 20 and cantilevering from the bottom wall 20 coaxially to the unwinding axis 22.

The hub 27 ends against the lid 24 and has an outer size so as to support the reel 8 so that it may rotate about the unwinding axis 22 and can be slidably inserted and extracted along the unwinding axis 22, when the lid 24 is removed.

The chamber 26 communicates with the outside through a strip outlet opening 28 made through the side wall 21 and opening into a channel 29 that guides the strip 5 towards the opening 13 of the forming and cross-cutting apparatus 12.

The casing 18 is coupled to the frame 15 via a positioning and handling device 30 configured to allow the casing 18 and the hub 27 to be the displaced between a backward or retracted position in which the strip 5 is fed to the forming and cross-cutting apparatus 12, shown in FIGS. 1, 2, 4, and 6, and in which the casing 18 extends between the sugar dispensing apparatus E and the cup supply apparatus F, and a forward or extracted position in which the reel 8 may be changed or loaded, shown in FIGS. 3, 5, 7, and 8, and in which the casing 18 protrudes outside the sugar dispensing apparatus E and the cup supply apparatus F.

Figure 2:
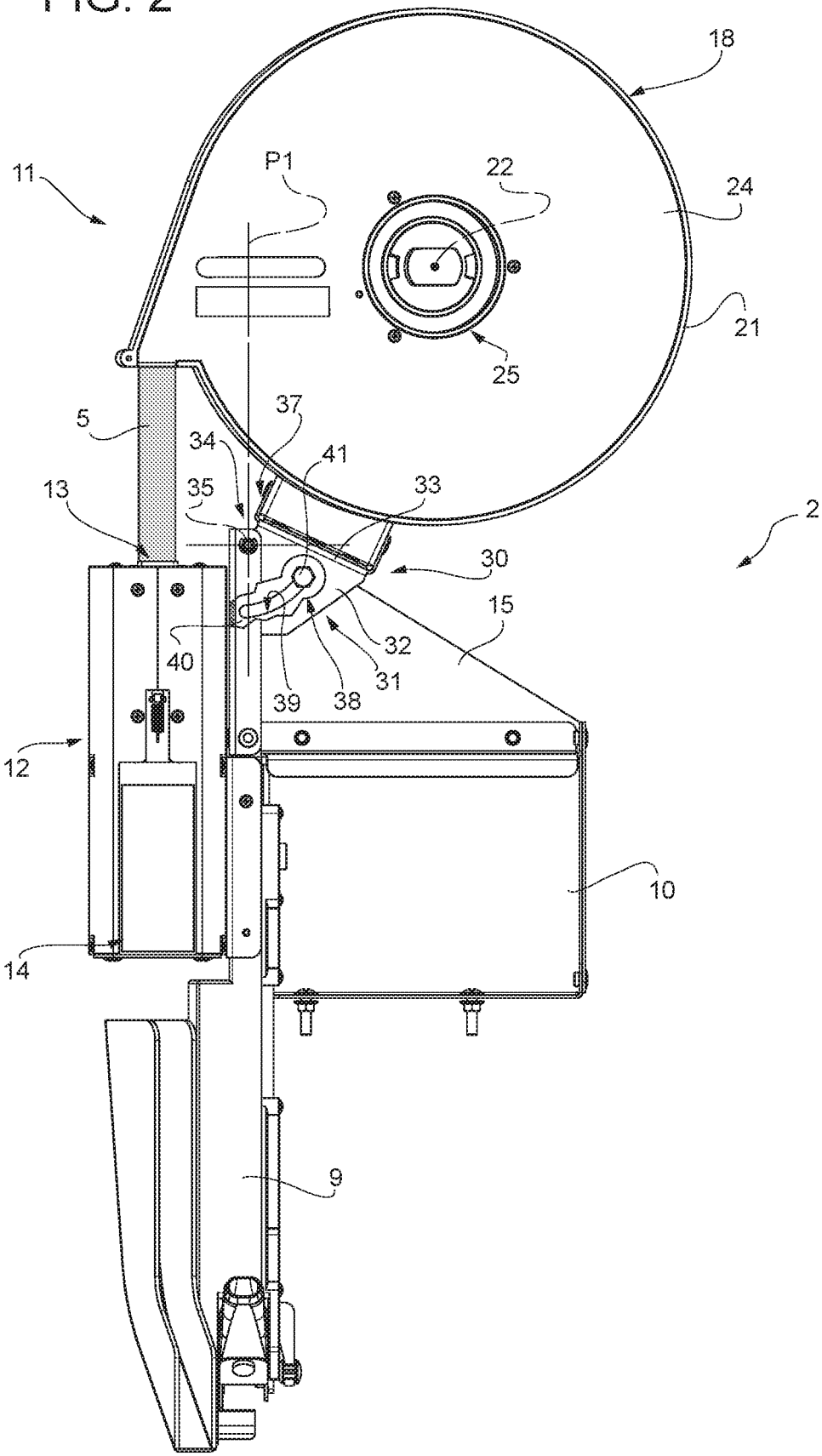
FIGS. 2 and 3 are views, in side elevation and on an enlarged scale, of an assembly of the beverage vending machine shown in FIG. 1 and arranged in two different operating conditions.
Figure 3:
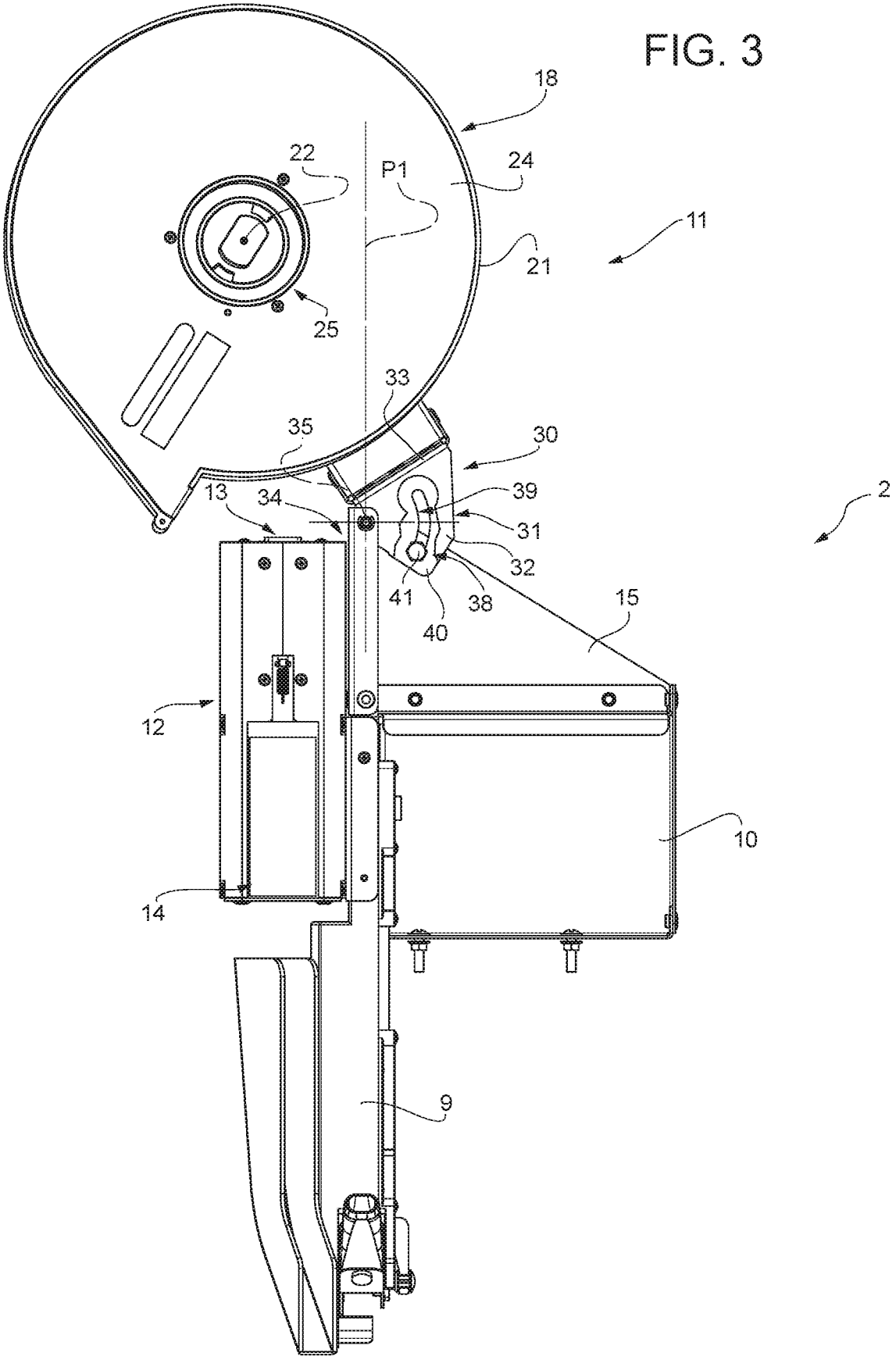

With reference to FIGS. 2, 3, and 8, the positioning and handling device 30 comprises an inverted U-shaped or fork-shaped bracket 31 with two parallel and facing arms 32 and a cross member formed by a plate 33. The arms 32 are hinged to the frame 15 via a hinge 34 that has a common hinge pin for rotating about a horizontal, fixed hinge axis 35.

In the example described (FIGS. 2 and 3), when the casing 18 is arranged in the strip feeding and reel changing or loading positions, the unwinding axis 22 is arranged on opposite sides of a vertical plane P1 on which the hinge axis 35 lies.

A lower portion of the side wall 21 angularly spaced from the opening 28 is firmly connected to the plate 33 via a bracket 37, which forms part of the positioning and handling 30.

The positioning and handling device 30 further comprises an angular positioning assembly 38 for positioning the casing 18 and the hub 27 in the above-mentioned strip feeding and reel changing or loading positions.

Conveniently, the angular positioning assembly 38 comprises at least one mechanical cam formed by a slot 39 formed on a wall 40 fixed to an internal side of the bracket 31, and an abutment member formed by a hinge 41 that slides inside the slot 39 and is fixed to the frame 15.

Figure 4:
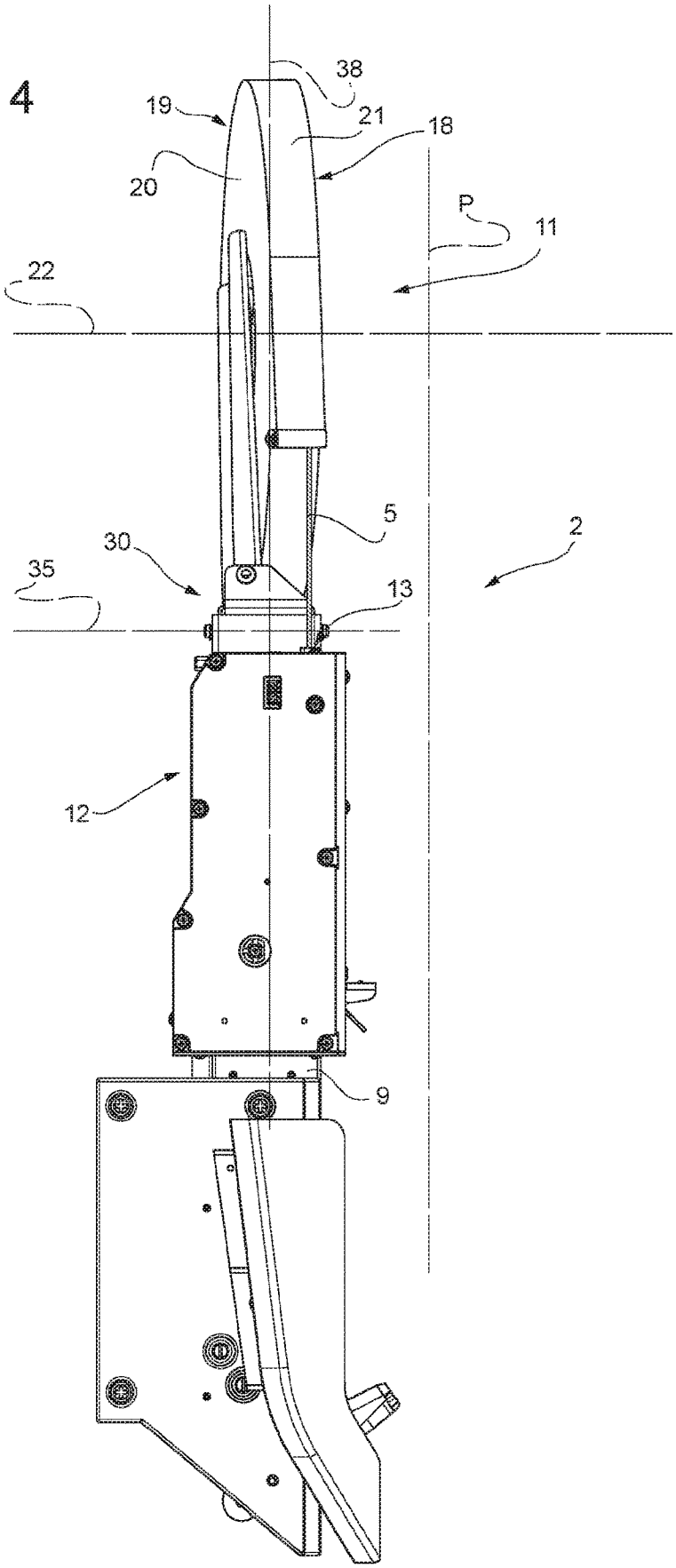
FIGS. 4 and 5 are front views of the assemblies shown in FIGS. 2 and 3, respectively.

As shown in FIGS. 4 and 6, the bracket 37 and its coupling to the casing 18 are provided so that when the casing 18 is arranged in the strip feeding position it is rotated clockwise about a vertical axis 38 (FIG. 4) so that the unwinding axis 22 is arranged horizontally and is tilted so as to form an angle K (FIGS. 6 and 7) other than 90° with a vertical plane P orthogonal to the axis 35.

Figure 7:
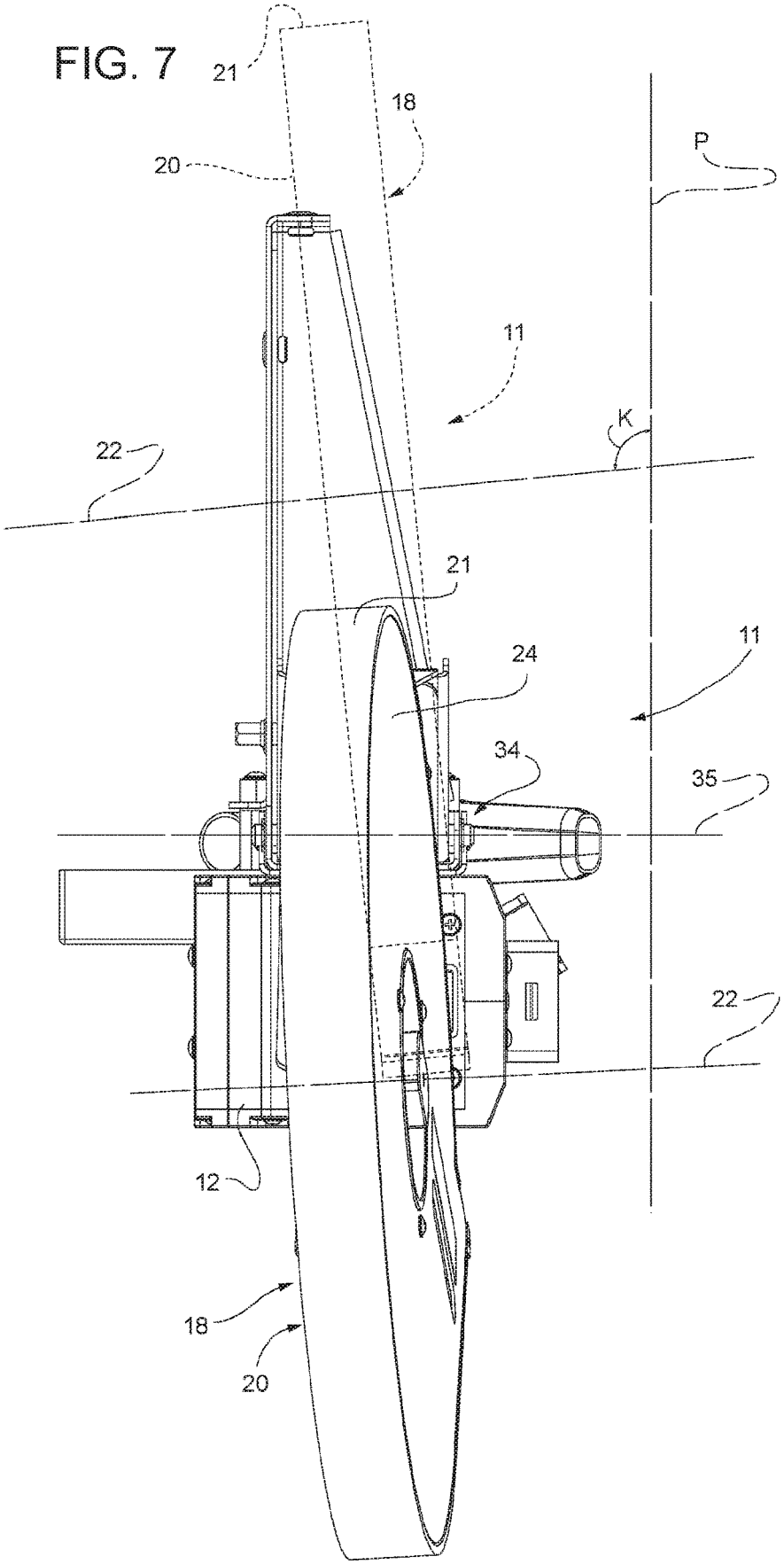
FIG. 7 is a top view of the assemblies shown in FIGS. 3 and 5.

In this way, the axes 22 and 35 are parallel, horizontal and mutually oblique (FIGS. 6 and 7).

Figure 5:
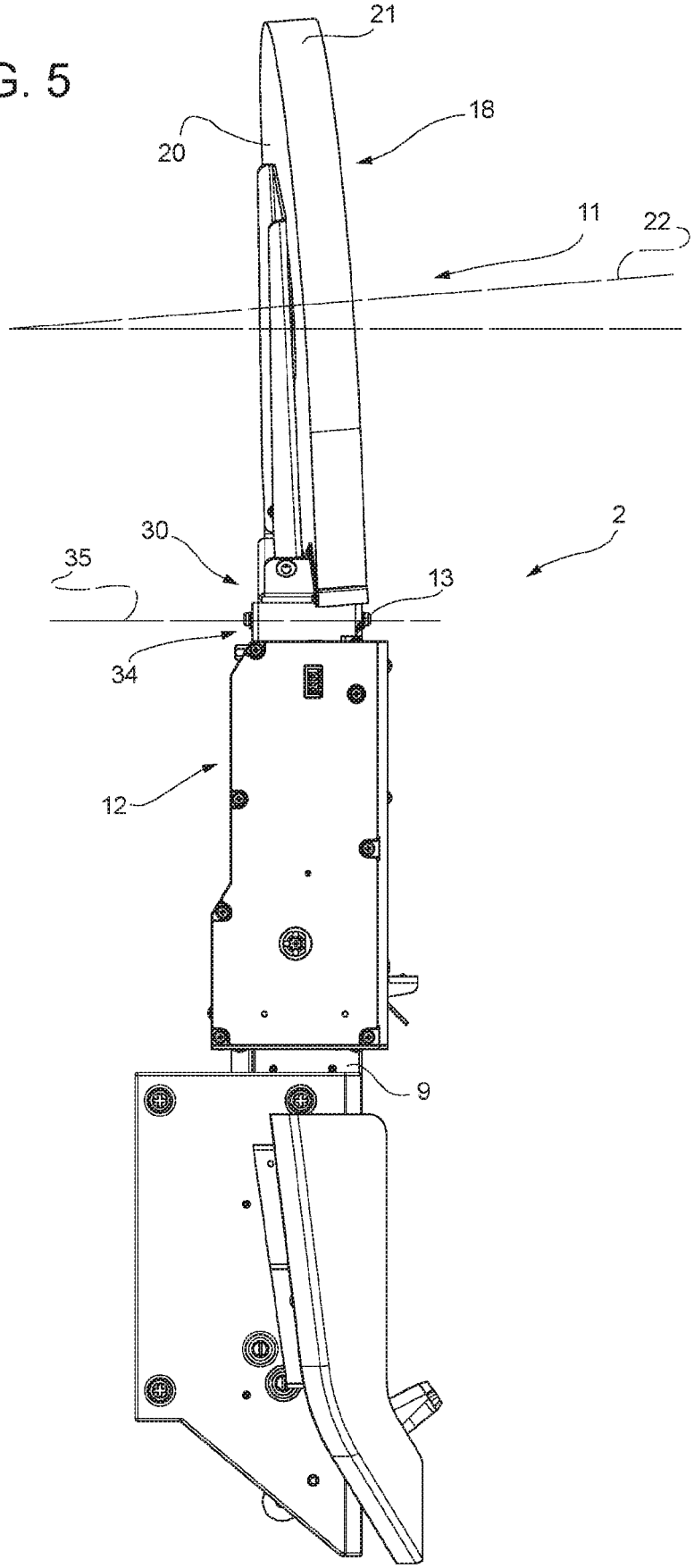

The tilting of the unwinding axis 22 in relation to the vertical plane P is, in all cases, chosen so that, when the casing 18 and the hub 27 are arranged in the reel changing or loading position, shown in FIGS. 5 and 7, the unwinding axis 22 is tilted downwards and towards the bottom wall 20.

From the above, it may be appreciated that the strip feeding apparatus 11 enables the strip 5 to be fed when the casing 18 and the hub 27 are arranged in the backward or retracted position and simplifies and speeds up the operations for changing the reel 5 especially due to the fact that it provides for the displacement of the casing 18 in a forward or extracted position for changing the reel.

Moreover, when the casing 18 is arranged in the reel changing position, the hub 27 is tilted downwards and towards the wall 20 so that the new reel, when coupled to the hub 27, and during the initial unwinding, tends to slide spontaneously towards the bottom wall 20 that acts as a reference and axial stop, reaching an axial stability condition.

In this condition, the machine operator may, therefore, dedicate to inserting the initial section of the new strip into the forming and cross-cutting apparatus 12 without worrying, at all, about the possible fall or coming out of the reel 8 from the hub 27, not even in the absence of the closing lid 24 that may, however, be inserted before the displacement of the frame 18 with the inside of the corresponding reel 8 in its backward or retracted position.

From the above, it may be further appreciated that the strip feeding apparatus 11 also allows the strip waste resulting from the fall of the new reel to be eliminated and the machine stoppage to be significant reduced.

From the above, it may be finally appreciated that the forward rotation or extraction of the casing 18 until bringing it into the reel changing position makes it possible to produce a beverage vending machine 1 that is compact since the casing 18 may be arranged between other components during the strip feeding step and, for example, between the sugar dispensing apparatus E and the cup feeding apparatus F, and, thus, in a position inaccessible from the outside, and be extracted making it, instead, accessible from outside for reel changing only.

From the above, it may be further appreciated that the strip feeding apparatus 11 can be modified without departing from the scope of protection defined by the appended claims.

In particular, the casing 18 may be produced in a manner other than that described and the reel 8 may be supported in another way and, for example, by the wall 21.

Furthermore, the casing 18 may have a different shape from that described and, for example, so as to only partially house the reel 8.

In addition, the positioning and handling device 30 may be replaced with other lever or cam handling devices as long as they are designed to enable not only the advance of the frame 18 into the reel changing position but also to bring the unwinding axis 22 into a tilted position in relation to the horizontal strip feeding position. In particular, the hinge axis 35 may not be horizontal or not be stationary in relation to the frame 15, just as the positioning and handling assembly 30 may be replaced with equivalent end-of-stroke devices.

The invention claimed is:

1. A strip feeding apparatus for a stirrer dispenser in a beverage vending machine, the strip feeding apparatus comprising:

a mounting frame to be mounted to a fixed body;

a support for a strip reel;

a flat reel abutment wall;

wherein the support is integral with, and cantilevers from, the flat reel abutment wall, coaxially to a reel unwinding axis orthogonal to the flat reel abutment wall and is configured to support the strip reel so that the strip reel is rotatable about the reel unwinding axis and axially slide along the strip reel unwinding axis with respect to the flat reel abutment wall; and a positioning and handling device arranged between the support and the mounting frame to allow the support to move with respect to the mounting frame between a strip feeding position and a reel loading or changing position, and to arrange the reel unwinding axis horizontally, when the support is arranged in the strip feeding position, and tilting downwards and towards the flat reel abutment wall, when the support is arranged in the reel loading or changing position;

wherein the positioning and handling device comprises a hinge arranged between the mounting frame and the support and having a hinge axis fixed with respect to the mounting frame, and an angular positioning assembly configured to allow the support to rotate with respect to the mounting frame and about the hinge axis between the strip feeding position and the reel loading or changing position, the angular positioning assembly including at least one mechanical cam carried by one of the support or the mounting frame, and at least one abutment member arranged to cooperate with the cam and carried by the other of the support or the mounting frame; the reel unwinding axis forming an angle other than 90° with a reference plane orthogonal to the hinge axis.

2. The strip feeding apparatus of claim 1, wherein the hinge axis is horizontal.

3. The strip feeding apparatus of claim 1, wherein when the support is arranged in the strip feeding and reel strip feeding apparatus changing or loading positions, the reel unwinding axis is arranged on opposite sides of a vertical plane on which the hinge axis lies.

4. The strip feeding apparatus of claim 1, wherein the abutment member is formed by a fixed abutment pin, and the cam is formed by a movable slot slidably engaged by the abutment pin.

5. A stirrer dispenser for a beverage vending machine, the stirrer dispenser comprises a support frame, a strip feeding apparatus coupled to the frame to feed a strip wound to form a reel, and a shaping and cross-cutting strip apparatus to shape and cross-cut the strip to form the stirrers; wherein the strip feeding apparatus is as claimed in claim 1.

* * * * *